United States Patent [19]

Pearce

[11] 4,279,222

[45] Jul. 21, 1981

[54] FEED OF MATERIAL TO FLUIDIZED BEDS

[75] Inventor: Arnold P. Pearce, Chelwood Gate, England

[73] Assignee: Flameless Furnaces Limited, London, England

[21] Appl. No.: 88,672

[22] Filed: Oct. 26, 1979

Related U.S. Application Data

[63] Continuation of Ser. No. 934,921, Aug. 18, 1978, abandoned.

[30] Foreign Application Priority Data

Aug. 19, 1977 [GB] United Kingdom ..... 34814/77
Nov. 24, 1977 [GB] United Kingdom ..... 48928/77

[51] Int. Cl.[3] ..... F22B 1/02
[52] U.S. Cl. ..... 122/4 D; 110/165 R; 110/245; 110/263; 431/170
[58] Field of Search ..... 122/4 D; 110/245, 263, 110/165 R; 431/7, 170

[56] References Cited

U.S. PATENT DOCUMENTS

| | | | |
|---|---|---|---|
| 3,685,165 | 8/1972 | Deve | 110/245 X |
| 3,859,963 | 1/1975 | Roberts et al. | 110/245 X |
| 3,882,798 | 5/1975 | Reese | 110/245 |
| 3,893,426 | 7/1975 | Bryers | 110/245 X |
| 3,921,590 | 11/1975 | Mitchell et al. | 110/243 X |

FOREIGN PATENT DOCUMENTS

| | | | |
|---|---|---|---|
| 498034 | 9/1967 | France | 110/245 |

*Primary Examiner*—Edward G. Favors
*Attorney, Agent, or Firm*—Ladas & Parry

[57] ABSTRACT

The invention provides a fluidized bed combuster for fuel or waste material, preferably having a fluidized bed which is arranged to circulate about a horizontal axis, in which one or more baffles are provided to define respective quiet zones adjacent the fluidized bed; material flowing in operation of the bed over the top of the baffle from the fluidized bed to the quiet zone and under the baffle from the quiet zone to the fluidized bed; and means is provided for feeding material to be burnt into the quiet zones to be carried therefrom beneath the baffles into the fluidized bed for combustion therein.

16 Claims, 12 Drawing Figures

FEED OF MATERIAL TO FLUIDIZED BEDS

This application is a continuation of Ser. No. 934,921, 8-18-78, abandoned.

BACKGROUND OF THE INVENTION

This invention relates to fluidised bed combustion apparatus and to furnaces and incinerators embodying such equipment. The invention is particularly concerned with the feed of material to be burnt in the fluidised bed, such material being either waste material or low grade fuel to be burnt with the object either of disposal or the generation of heat for a useful purpose.

It has been proposed to provide a fluidised bed combustion apparatus in which a fluidised bed of granular material is supported in a housing or combustion chamber on an air diffuser bed support. In such an arrangement fuel or waste material to be burnt either to raise heat or for disposal purposes is fed into the fluidised bed to be burnt therein. The oxygen for combustion comes at least in part and usually entirely from air fed into the bed from the diffuser support to fluidise the bed. The bed is usually formed of granular material such as sand or other refractory material and may comprise in part ash residue from previous combustion.

The diffuser is in some cases arranged to slope from one side of the bed to the other and the supply of fluidising air to the various areas of the diffuser is selectively controlled to cause the bed materials to circulate about a generally horizontal axis extending across the slope of the diffuser.

It is an object of the present invention to provide an arrangement for feeding material to be burnt into a fluidised bed, particularly a fluidised bed which is arranged to circulate in the manner described above about a generally horizontal axis.

SUMMARY OF THE INVENTION

Accordingly the present invention provides a fluidised bed combuster comprising a housing having an air diffuser bed support arranged to support and fluidise a bed of granular material in a housing, and at least one baffle extending in a generally vertical plane and vertically spaced from the bed support to define on one side of the bed a quiet zone of bed material which is not fluidised in operation in communication beneath the baffle with the remainder of the bed which is fluidised in operation, the top of the baffle lying below the upper surface of the bed in operation.

Preferably such a combuster includes feed means arranged to feed material to be burnt into the quiet zone for passage from that zone under the baffle into the fluidised zone in operation.

In a preferred arrangement the invention provides a combuster including two such baffles so arranged on opposite sides of the bed support to define two such quiet zones each with means for feeding material to be burnt into it.

BRIEF DESCRIPTION OF THE DRAWINGS

In order to promote a fuller understanding of the above and other aspects of the invention, some embodiments will now be described, by way of example only, with reference to the accompanying drawings in which.

DESCRIPTION OF PREFERRED EMBODIMENTS

Figure 5:
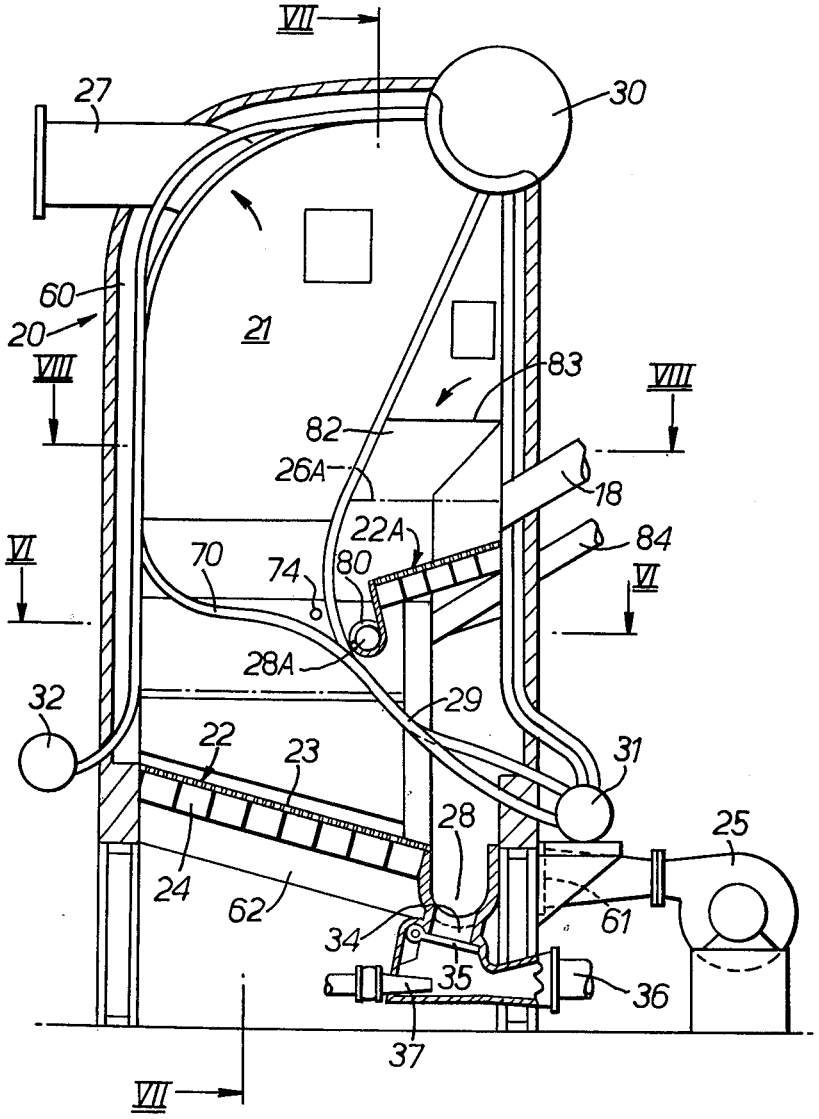
FIG. 5 is a schematic cross-sectional elevation similar to that of FIG. 1 of a second embodiment of the invention embodying a dual fluidised bed.

In the various embodiments described below with particular reference to FIGS. 1, 5 and 9 of the drawings, where parts are of generally similar construction, or serve a similar purpose, they are given the same reference number and will only be described once.

Figure 1:
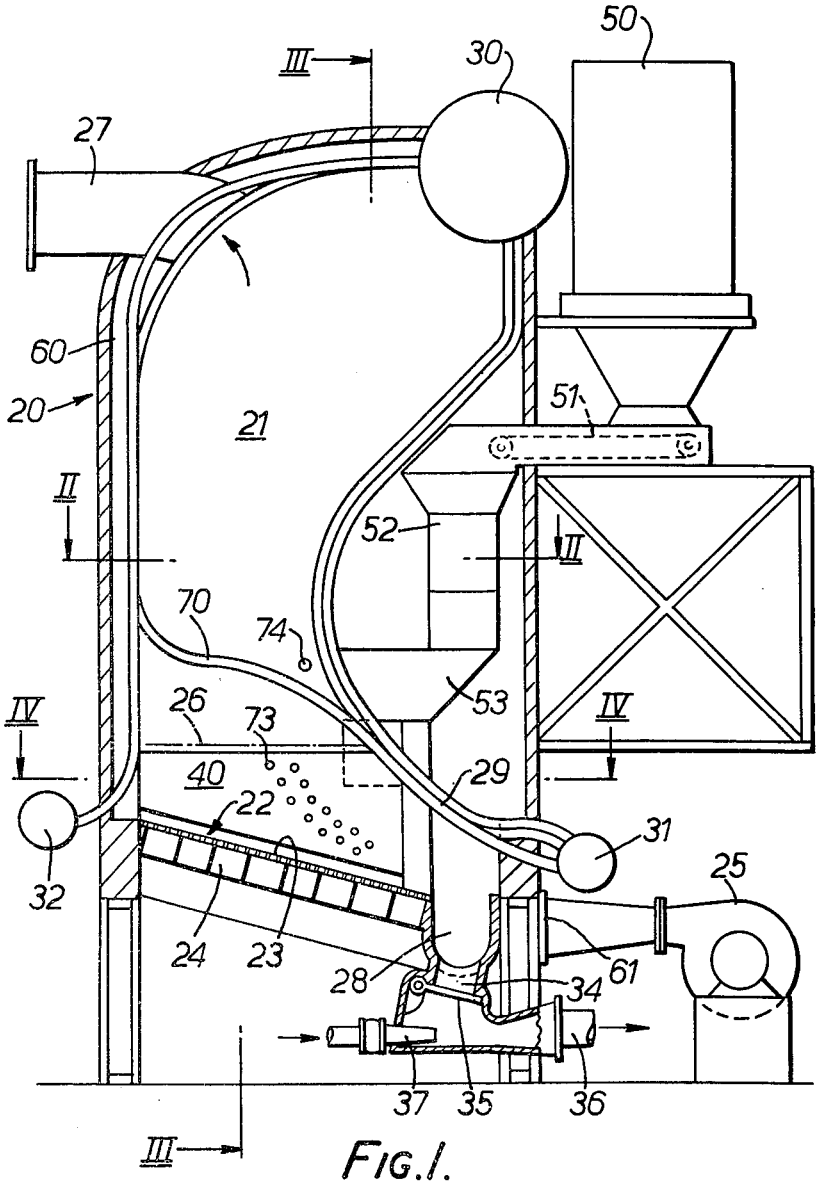
FIG. 1 is a schematic cross-section of a fluidised bed combuster embodying the invention.

FIG. 1 shows in schematic cross-section a fluidised bed combuster embodying the invention. The combuster comprises a housing 20 forming a combustion chamber 21 having disposed in the bottom thereof an air diffuser bed support indicated generally at 22. The diffuser 22 comprises a porous or perforated surface 23 which is supplied with air through a series of plenum chambers 24 from a blower system indicated generally at 25. Control means (not shown) is provided for controlling the amount of air supplied to each of the plenum chambers 24 so that the air flow over the surface of the bed support 22 can be controlled. A bed of material is supported in the chamber 21 on the support 22 and has an upper surface level indicated at 26. At the top of the chamber 21 a flue 27 is provided in the housing 20 for the escape of combustion gases.

In operation the bed of material is fluidised by air entering it through the support 22 and material to be burnt is fed into the fluidised bed and burnt therein with the products of combustion leaving through the flue 27. The distribution of the air supplied from the surface 23 is controlled so that the material of the bed circulates about a generally horizontal axis extending through the plane of FIG. 1. This circulation is preferably in an anti-clockwise direction as seen in FIG. 1 and is thus such that there is a flow generally down the length of the surface 23, which as seen in FIG. 1 is arranged to slope downwards to the right in the Figure.

An ash trough 28 is provided along the lower edge of the bed support 22 to collect ash and other incombustible material resulting from combustion in the bed. The above described circulation of the bed assists in the accumulation of such material in the ash trough 28.

A baffle structure 29 disposed above the right hand portion of the bed as seen in FIG. 1 and sloping upwards and away from the ash trough 28 assist in the circulation of the bed. The baffle structure 29 is preferably constructed from a series of heat exchange tubes carrying water in a water cooling system between an upper header indicated at 30 and a lower header indicated at 31. The rest of the chamber 21, particularly above the level 26 is also lined by heat exchange water tubes forming part of the system, a second lower header 32 also being provided. Thus the water tubes both in direct contact with the material of the bed, and in contact with the flue gases above the bed are arranged to extract useful heat from the combustion process for the generation of hot water or steam or any other purpose.

The ash trough is provided with a central outlet aperture 34 which is provided with a flap valve 35 which, upon opening, places it in communication with an ash duct 36. Ash, together with any entrained bed material, in the ash trough 28 is conducted through the ash duct 36 pneumatically on the injection of air through a jet 37 in a manner which is disclosed and claimed more particularly in co-pending British Patent Application No. 18354/77.

Figure 2:
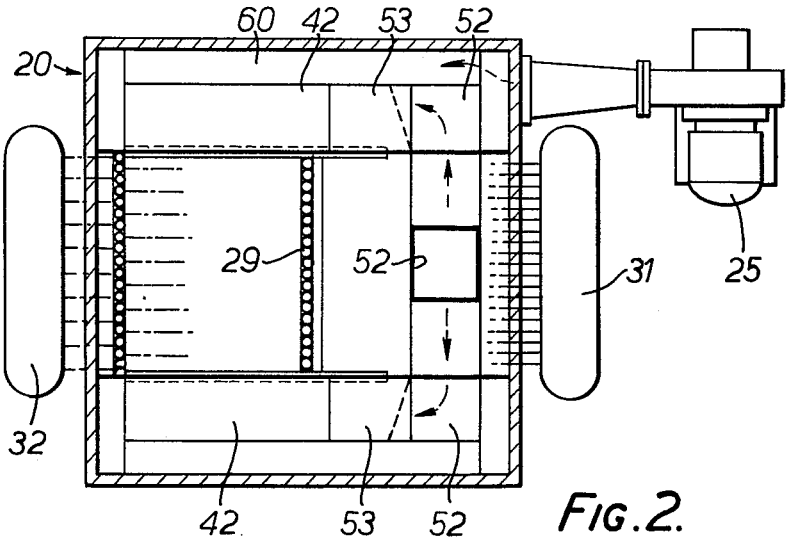
FIG. 2 is a schematic plan view taken on the line II—II of FIG. 1.
Figure 4:
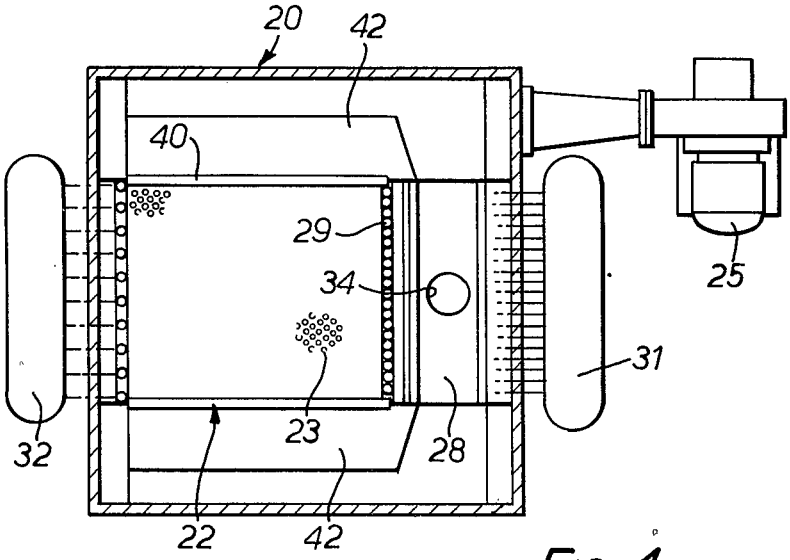
FIG. 4 is a schematic plan view taken on the line IV—IV of FIG. 1.
Figure 3:
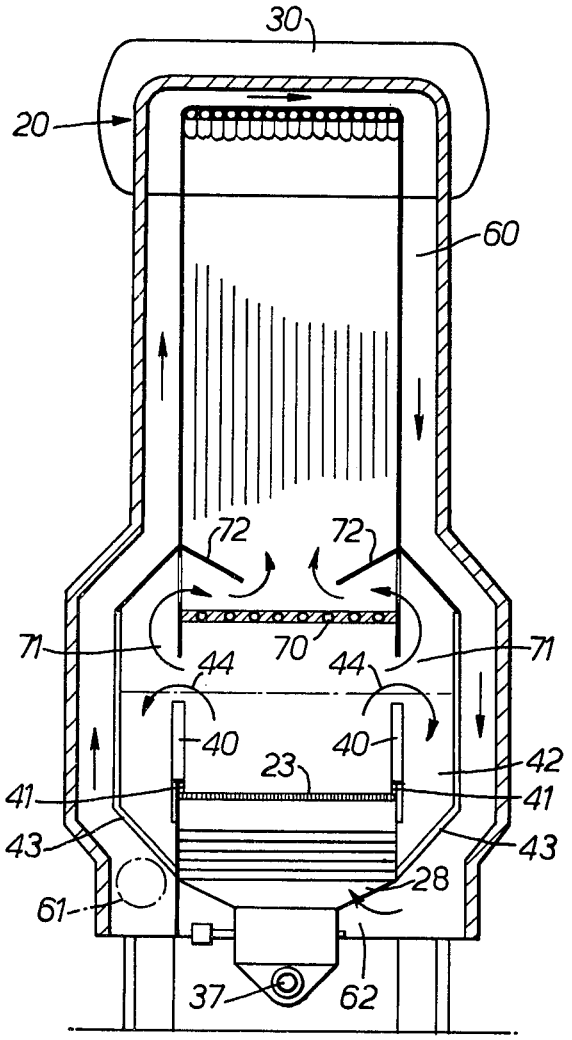
FIG. 3 is a schematic cross-section taken on the line III—III of FIG. 1.

As best seen in FIGS. 2, 3 and 4, a baffle 40 is provided on each side of the bed support 22 extending in a generally vertical plane. A gap 41 is left underneath the baffle above the surface 23, and the baffle extends upwards to a point just below the level 26 of the bed when it is fluidised in operation. The housing 20 includes chambers or zones 42 disposed outside the baffles 40. The bottom walls of the chambers 42 preferably slope downwards and inwards from the sides of the housing 20 to meet the surface 23 of the bed support 22, as indicated at 43.

The arrangement is such that during operation of the bed, the baffles 40 define quiet zones on either side of the fluidised bed, which are not fluidised in operation. The level of the bed 26 which is inevitably raised somewhat when the bed is fluidised, is above the top edges of the baffles 40 and as a consequence materials circulate over the baffles 40 in a direction transverse to the main circulation of the bed which is described above, as indicated by the arrows 44. Bed material in the quiet zones 42 thus also circulate back into the bottom of the fluidised portion of the bed through the gaps 41. The sloping sides 43 assist in this mechanism.

A hopper 50 (FIG. 1) for material to be burnt, is provided on the structure of the housing 20. Suitable metering feed means indicated generally at 51 is provided to convey material to be burnt to an inlet duct 52 which is generally centrally disposed at the side of the combustion chamber 21. The duct 52 is branched out on either side to lead to an inlet chute 53 on each side of the fluidised bed, opening into the chambers 42 enclosing the quiet zones in the bed material. Material to be burnt is carried downwards through these quiet zones into the bottom of the fluidised zone of the bed by the transverse circulation described above. Thus it can be seen that material to be burnt is carried into the bottom of the bed with a result that very little unburnt material ever reaches the surface of the bed in operation and thus escape of light unburnt material into the chamber 21 above the bed is virtually eliminated. The outlets 53 preferably face downwards as shown in the drawings to this purpose.

The housing 20 preferably includes as shown an air jacket 60 forming part of the conduit system between the blower 25 and the diffuser plenum chambers 24. The arrangement is such that the air passes from the blower 25 into the jacket 60 at a point 61, up on the left hand side as seen in FIG. 3, over the top of the chamber 21 and down on the right hand side as seen in FIG. 3 into a space 62 below the plenum chambers 24 and thence by way of suitable control valves into the plenum chambers of the diffuser. Thus the air circulation assists in cooling the structure of the combustion chamber, and retrieves heat from it and passes it back into the bed.

As best seen in FIG. 3, a branch 70 of baffle structure 29 extends over the surface of the bed as seen in FIG. 1 and FIG. 3. Flue gases leaving the surface 26 of the bed in operation pass round on either side of the baffle portion 70 through gaps indicated at 71 in FIG. 3, under baffles 72 into the upper part of the chamber 21 to leave through the flue exit 27. This tortuous path for the flue gases further assists in preventing light and volatile materials leaving the combuster before they have been completely burnt.

The baffle portion 70 is preferably part of the heat exchange water system and assists in the extraction of useful heat from the combustion process. Further the baffles 40 may also be constructed either as air cooled or water cooled baffles contributing to the extraction of useful heat from the combustion process.

Further heat exchange tubes may be immersed in the fluidised portion of the bed as indicated at 73 in FIG. 1, such tubes being connected into the heat exchange system.

Air jets 74 may be provided in the chamber 21 above the baffle portion 70 to keep it clear of any fly ash or other combustion products which may settle there.

FIGS. 5 to 8 show an embodiment similar to that described above only with a further fluidised bed interposed between the feed channel 18 of the previous embodiment, and the feed outlets 53 into the quiet zones in the chambers 42.

This further fluidised bed which will be referred to as a primary fluidised bed as opposed to the lower one which will be referred to as the secondary fluidised bed in this connection, comprises an air diffuser bed support **22*a* which is otherwise similar to that shown at 22. The bed support 22*a* slopes, in the opposite direction to the bed support 22, down to an ash trough 28*a*. Air is supplied from the blower 25 to the bed support 22*a* to fluidise granular material forming a bed thereon to a level indicated at 26*a***.

Figure 6:
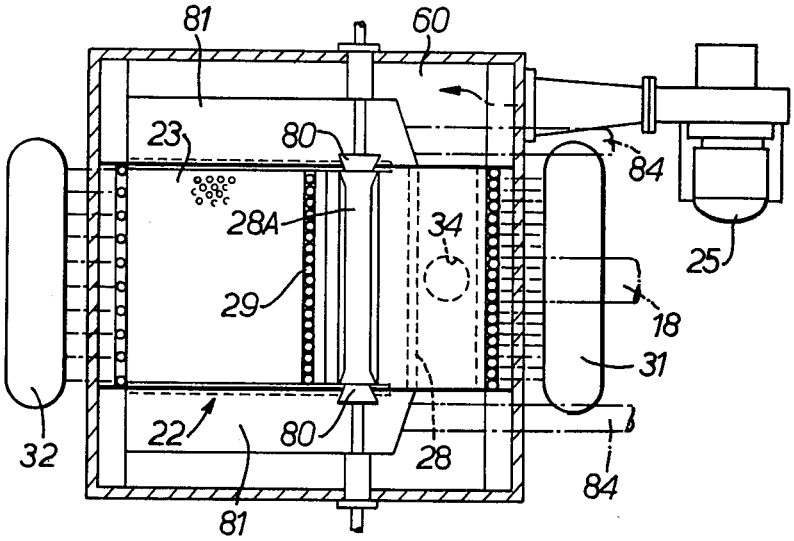
FIG. 6 is a plan view taken on the line VI—VI of FIG. 5.
Figure 8:
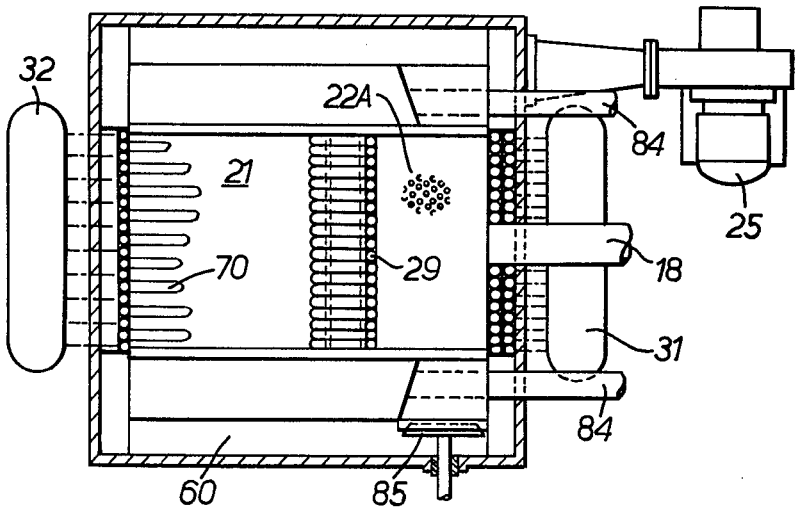
FIG. 8 is a plan view taken on the line VIII—VIII of FIG. 5.
Figure 7:
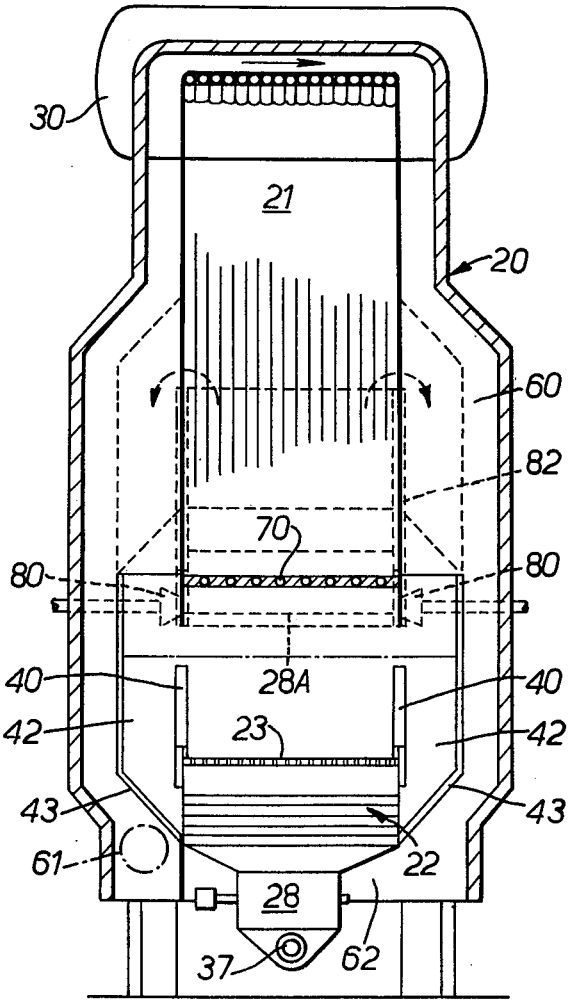
FIG. 7 is a cross-sectional view taken on the line VII—VII of FIG. 5.

As best seen in FIG. 6 the ash trough **28*a* includes a valve 80 at either end in the form of a plug valve, which on opening, allows material from the primary bed to fall down from the trough 28*a* into respective regions 81 and thence to the outlets into the chambers 42 containing the quiet zones on either side of the secondary fluidised bed. The chamber containing the primary fluidised bed is bounded by side walls 82 which terminate at an upper edge 83 leaving passages over which combustion gases from the primary fluidised bed can pass down and into the chamber 21 beneath the baffles 72** to mix with the combustion gases leaving the secondary bed.

Air for supply to the plenum chambers of the primary bed support **22*a* is bled from the air jacket 60 by way of a control valve 80 (FIG. 8) to lead into a wind box 86 arranged to supply the plenum chambers by way of control means. The operation of the primary bed may be such that it circulates about a horizontal axis passing through the plane of FIG. 5**, as discussed above, or it may be such that it is simply fluidised.

It is intended that the primary fluidised bed should operate to partially burn material fed into it through the feed duct 18, combustion being completed in the secondary bed. Additional fuel or waste material to be burnt can be fed directly into the secondary bed, by way of the quite zones of the bed contained in the chambers 42 by means of additional inlet ducts 84.

By the provision of the primary bed as discussed above, it is possible to further eliminate the possibility of unburnt material leaving the surface of the secondary bed because material entering the secondary bed is already partially burnt having undergone a pyrolysis stage in the primary bed and most volatile material burnt off in gaseous form. Such an arrangement is particularly suitable for the burning of waste material including organic material, particularly having a high fat content, or alternatively material having a high volatile content.

Figure 9:
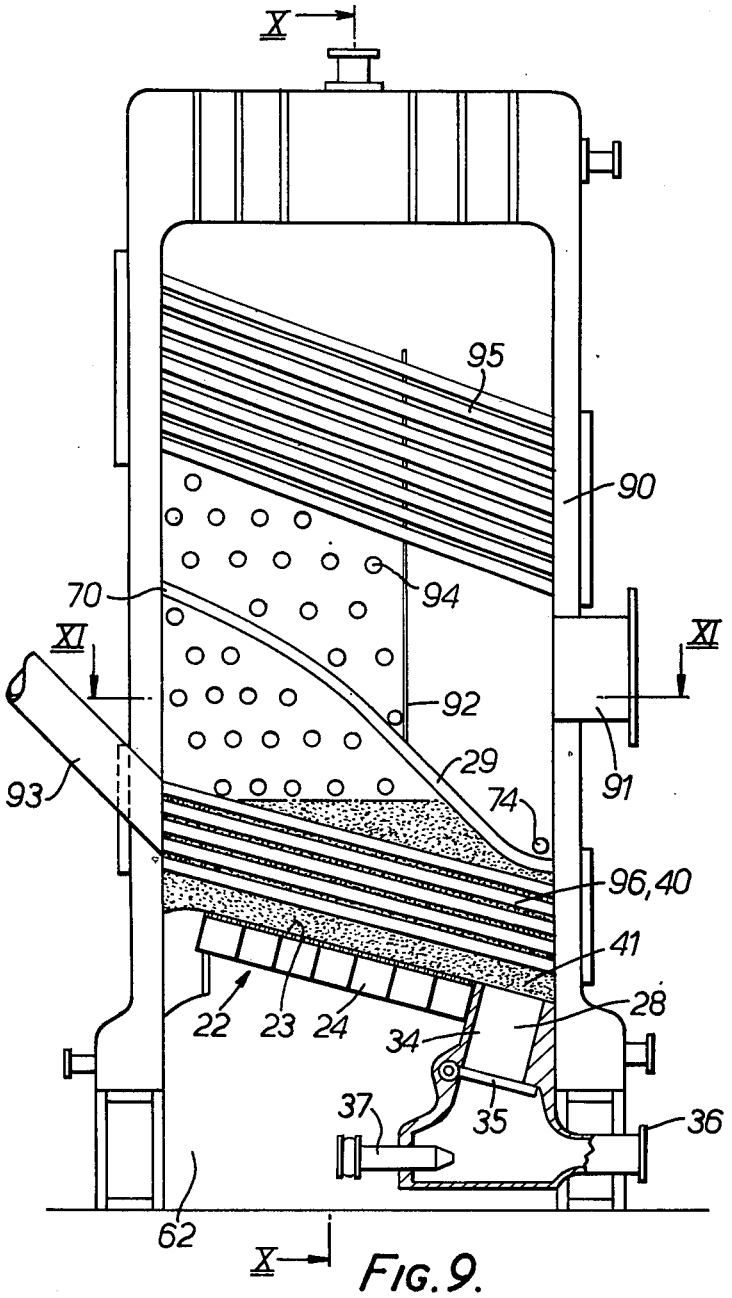
FIG. 9 is a cross-sectional elevation of a further embodiment of the invention.
Figure 10:
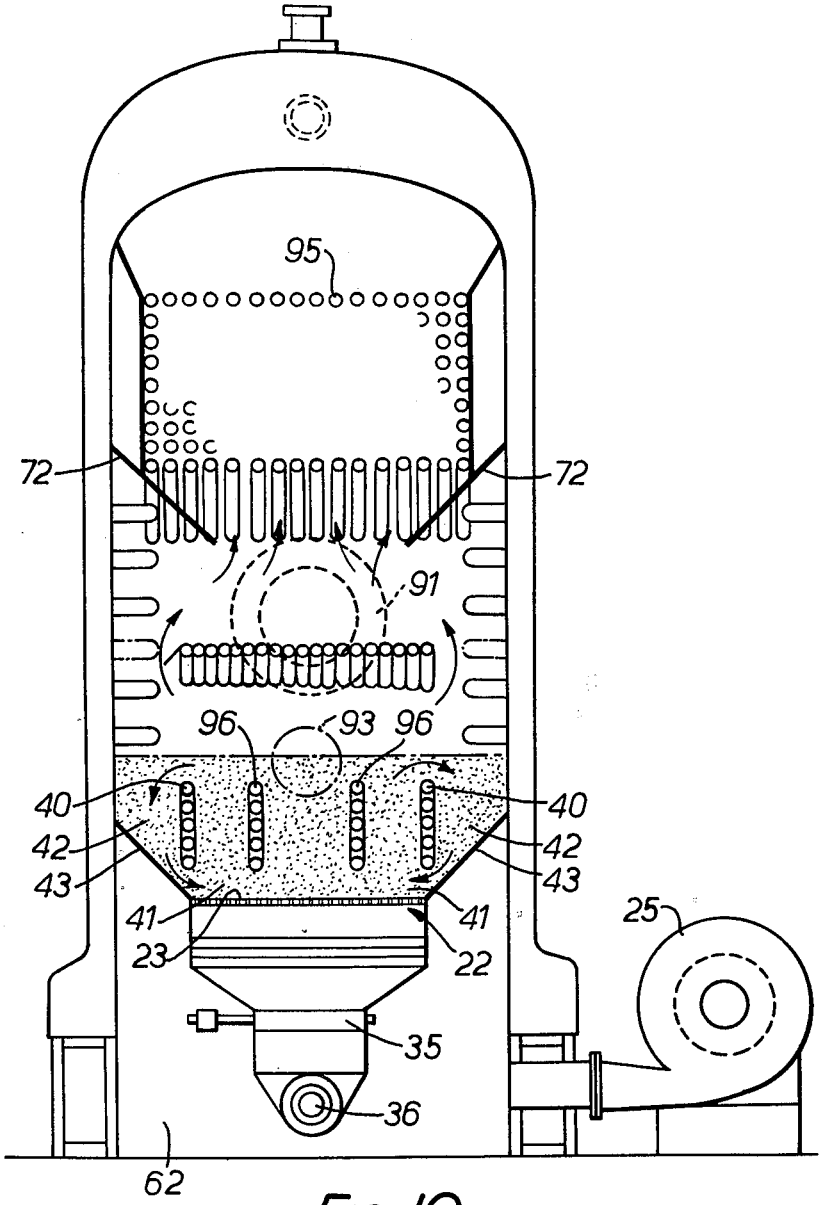
FIG. 10 is a cross-sectional view taken on the line X—X of FIG. 9.
Figure 11:
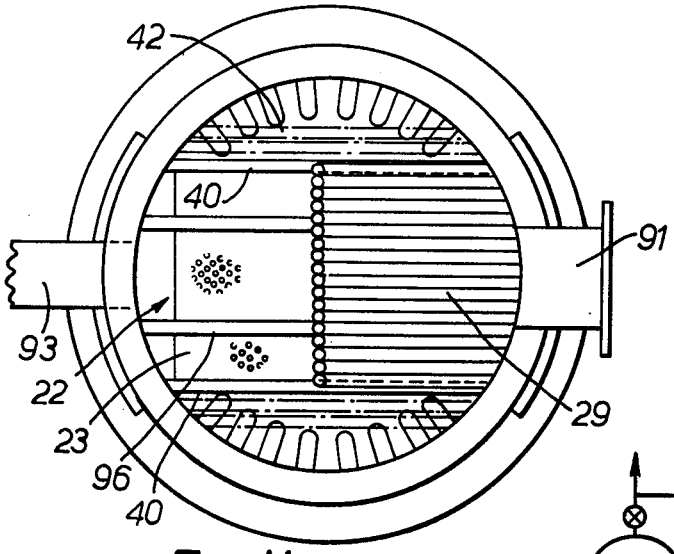
FIG. 11 is a plan view taken on the line XI—XI of FIG. 9.

FIGS. 9, 10 and 11 show an alternative arrangement of a fluidised bed generally similar to that shown in FIG. 1 only arranged in a vertical cylindrical housing. In this arrangement the housing 90 is in the form of a water jacket having a double skin to enclose the chamber 21. The outlet flue 91 for combustion gases is disposed on the side of the chamber, and separated from the surface of the fluidised bed by a vertical baffle 92. The inlet 93 for fuel or material to be burnt may be as shown into a central region of the fluidised bed between the baffles 40, or it may be bifurcated to feed into the quiet zones in the chambers 42 on either side of the fluidised bed as discussed with regard to the previous embodiments.

The baffles 40 in this embodiment comprise water tubes extending between opposite sides of the water jacket of the housing 90 as does the baffle structure 29/70. Additional heat can be extracted from the combustion gases by means of thimble protuberances on the inner wall of the housing water jacket as indicated at 94, and additional water tubes extending in a grid formation across the upper part of the combustion chamber as indicated at 95. Additional water tubes can extend from opposite sides of the water jacket housing 90 through the fluidised portion of the bed as indicated at 96.

In other respects and in the manner of operation, the embodiment shown in FIGS. 9, 10 and 11 is exactly similar to that shown in FIGS. 1 through to 4.

Figure 12:
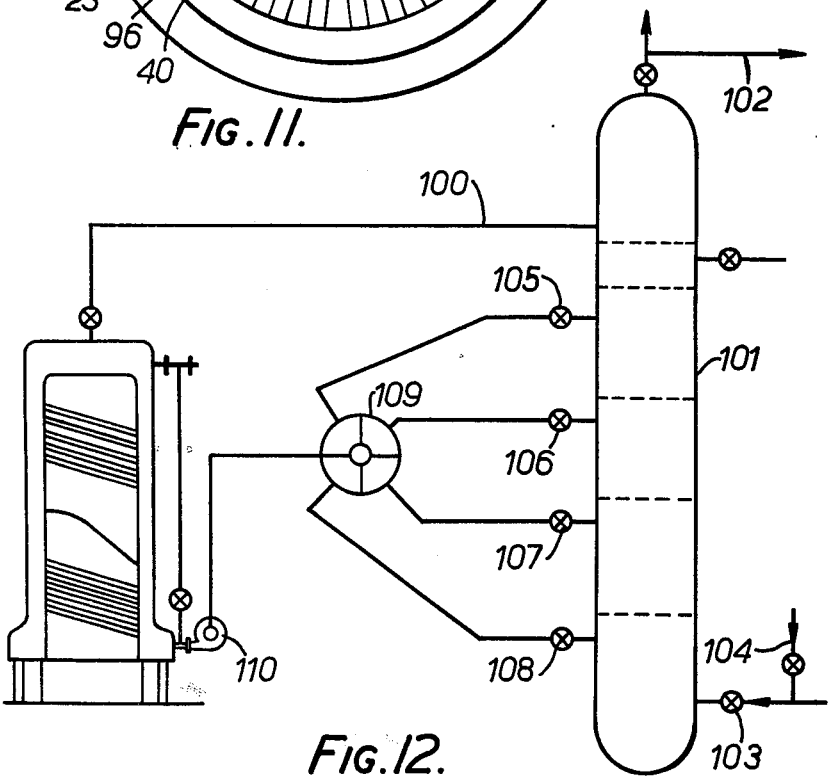
FIG. 12 is a schematic flow diagram of the water jacket system of the embodiment of FIG. 9.

FIG. 12 shows in schematic outline an arrangement for circulation of water through the water jacket of the housing 90 of the embodiment of FIGS. 9 to 11 to extract from it.

The upper part of the water jacket of the housing 90 is connected by way of a pipe 100 to the upper part of a vertical water storage cylinder 101. Hot water and steam may be taken off from the storage cylinder 101 by a pipe connection 102 at its top end. By the same token condensed water is returned to the bottom of the cylinder 101 by a return pipe 103, with any necessary make up water being supplied by way of a connection 104.

Because of the different density of water at various temperatures, there will be stratified layers of different temperature water in the cylinder 10, and a series of connections 105 to 108 with respective valves are provided along the vertical height of the storage cylinder. The connections 105 to 108 are connected by way of a selector valve 109 to a pump 110 for supply to the bottom of the water jacket of the housing 90. A by-pass with a suitable control valve is provided between the bottom inlet connection to the water jacket on an upper part to enable fluid to circulate in the water jacket during start-up operations or without circulation through the cylinder 101.

In operation, the temperature of water supplied from the cylinder 101 to the bottom of the water jacket may be selected by means of the valve 109, and thus a fine control may be exercised over the temperature of water entering the water jacket, and thus the amount of heat extracted from the fluidised bed at any time during combustion. Thus a fine control may be exerted over the bed temperature.

In the case of FIGS. 9, 10, 11 and 12 where the fluidised bed is enclosed in a substantial metal pressure casing the means are available for operating the said fluidised beds at pressures well above atmosphere. Thus the gases leaving the unit at 91 or at any other suitable position can be used to overcome back pressure from external equipment attached to the unit or alternatively to drive a gas turbine or similar type of unit forming part of the plant.

Embodiments of the invention in which an exclusive property or privilege is claimed are defined as follows:

1. A fluidised bed combuster comprising a housing having an air diffuser bed support arranged to support and fluidise a bed of granular material in the housing, and at least one baffle extending in a generally vertical plane and vertically spaced from the bed support to define on one side of the bed a quiet zone of bed material which is not fluidised in operation in communication beneath the baffle with the remainder of the bed which is fluidised in operation, the top of the baffle lying below the upper surface of the bed in operation so that material from the fluidised bed flows over the baffle into the quiet zone, the combuster including feed means arranged to feed material to be burnt into the quiet zone for passage from that zone under the baffle into the fluidised zone in operation.

2. A combuster as claimed in claim 1, including two such baffles so arranged on opposed sides of the bed support to define two quiet zones each with means for feeding material burnt into it.

3. A combuster according to claim 1, wherein means is provided to selectively control the supply of air to the diffuser bed support whereby a bed supported thereby may be fluidised to different degrees in different portions thereof so that it is caused to circulate about a horizontal axis.

4. A combuster according to claim 1, wherein the diffuser bed support is planar and generally rectangular in plan, and is arranged to slope downwards from one edge to the opposite edge, and an ash trough is provided along said opposite edge.

5. A combuster according to claim 4 wherein the ash trough includes an ash extraction means.

6. A combuster according to claim 5 wherein the ash extraction means comprises a selectively operable flap valve to control the output of ash from the trough, and pneumatic conveyor means for conveying ash from downstream of the flap valve.

7. A combuster according to claim 2, wherein said feed means comprises a hopper and conveyor means to carry material from the hopper to a bifurcated conduit arranged to feed material to be burnt to said two quiet zones.

8. A combuster according to claim 1 including a baffle structure disposed to lie over the surface of a portion of a bed of granular material supported on said air diffuser bed support.

9. A combuster according to claim 8 wherein said baffle structure is disposed to continue above the remainder of a bed of granular material supported on said air diffuser bed support to form a labyrinth path in said housing for combustion gases leaving such bed in operation.

10. A combuster according to claim 1 wherein said housing is provided with an air cooling jacket, and means is provided to circulate air supplied to said diffuser bed support through the air cooling jacket to pre-heat it.

11. A combuster according to claim 1 including heat exchange elements disposed to be in contact with the combustion gases leaving a fluidised bed in operation to extract combustion heat from the combuster.

12. A combuster according to claim 1 including heat exchange elements disposed to lie in the fluidised bed in operation to extract combustion heat from the combuster.

13. A combuster according to claim 1 wherein said housing is provided with a water jacket to cool it and extract combustion heat from the combuster.

14. A combuster according to claim 1 including a further air diffuser bed support arranged in a chamber associated with said housing to support and fluidise a further bed of granular material in the chamber, the chamber being provided with inlet means for material to be burnt to enter such further fluidised bed for preliminary combustion therein, and outlet means to feed partially combusted material to said quiet zones.

15. A combuster according to claim 14, wherein said oulet means from said chamber is provided with feed control valve means.

16. A combuster according to claim 1 wherein said housing is constructed as a circular cross-section cylindrical pressure vessel so that the combuster may operate at above ambient atmospheric pressure.

* * * * *